US005344286A

United States Patent [19]

Schäfer et al.

[11] Patent Number: 5,344,286

[45] Date of Patent: Sep. 6, 1994

[54] CENTRIFUGAL PUMP HOUSING

[75] Inventors: Horst Schäfer, Rhade; Günter Beiss, Bremen, both of Fed. Rep. of Germany

[73] Assignee: KSB Aktiengesellschaft, Frankenthal/Pfalz, Fed. Rep. of Germany

[21] Appl. No.: 573,036

[22] PCT Filed: Feb. 10, 1989

[86] PCT No.: PCT 1EP89/00124

§ 371 Date: Aug. 24, 1990

§ 102(e) Date: Aug. 24, 1990

[87] PCT Pub No.: WO89/08194

PCT Pub Date: Sep. 8, 1989

[30] Foreign Application Priority Data

Feb. 27, 1988 [DE] Fed. Rep. of Germany ..... 3806349

[51] Int. Cl.[5] ..... F01D 25/24; F01D 25/28

[52] U.S. Cl. ..... 415/213.1; 415/214.1

[58] Field of Search ..... 415/213.1, 214.1, 182.1; 248/671, 676

[56] References Cited

U.S. PATENT DOCUMENTS

| | | | |
|---|---|---|---|
| 704,038 | 7/1902 | Hope | 415/214.1 |
| 1,886,035 | 11/1932 | Mann | 415/213.1 X |
| 2,850,228 | 9/1958 | Rowley | 415/213.1 X |
| 2,850,262 | 9/1958 | Sprouse | 415/182.1 X |
| 2,929,218 | 3/1960 | Yates | 415/213.1 X |
| 3,776,660 | 12/1973 | Anderson et al. | 415/182.1 X |
| 3,791,760 | 2/1974 | Lipe | 415/182.1 X |
| 3,799,482 | 3/1974 | Bellati et al. | 415/213.1 X |
| 3,847,504 | 11/1974 | Martin | 415/214.1 X |
| 3,891,345 | 6/1975 | Doolin | 415/213.1 X |
| 4,900,224 | 2/1990 | Timperi et al. | 415/213.1 |

FOREIGN PATENT DOCUMENTS

| | | |
|---|---|---|
| 385893 | 2/1932 | Belgium . |
| 488377 | 9/1918 | France . |
| 1639 | 1/1913 | United Kingdom . |
| 190894 | 1/1923 | United Kingdom . |
| 317660 | 8/1929 | United Kingdom . |

*Primary Examiner*—Edward K. Look
*Attorney, Agent, or Firm*—Darby & Darby

[57] ABSTRACT

The invention relates to a longitudinally divided housing (1) of a flow machine. The lower part (3) of the housing (1) is provided with facets (10–13) in the region of the flange segment (4) and on the pump legs (8,9). The facets (10–13), which are located in planes intersecting the shaft axis and perpendicular thereto, serve as abutments upon attachment.

9 Claims, 2 Drawing Sheets

CENTRIFUGAL PUMP HOUSING

BACKGROUND OF THE INVENTION

The invention relates to a centrifugal pump of the type having a housing which is divided parallel to the shaft axis and comprises upper and lower housing parts provided with flange segments, the lower housing part having suction and pressure nozzles and being provided with legs.

Such centrifugal pumps, which are very readily accessible for eventual repairs and are generally equipped with double flow impellers, include a longitudinally divided pump housing with a shaft which is journalled at both ends. Since the suction and pressure nozzles are located below the plane of the shaft, the centrifugal pump housing must not be removed from the pipe for inspection or repair. By lifting off the upper part of the housing, the rotating components become easily accessible and can be removed without difficulty. A drawback of this design is the connection between pump and motor which requires a particularly stable foundation, frame or the like, as well as precise alignment of pump and motor, to ensure reliable operation with little wear.

A centrifugal pump with a housing divided parallel to the shaft axis is known from the French Publication No. 488.377. The lower part, which includes the suction and pressure nozzles, is provided with a base plate which also supports the bearings for the pump shaft. Installation of the pump at the erection site is made possible by means of the base plate, and particularly the lower side.

The Belgian Publication No. 385893 likewise shows a longitudinally divided housing. The front sides of the lower housing part are provided with mounting surfaces which serve to attach holders for the shaft bearings. Additional supports permit installation of the housing on a frame formed from double T-shaped carriers.

OBJECTS OF THE INVENTION

It is an object of the invention to develop an economical, longitudinally divided pump housing which can be coupled to a motor and can provide versatility in pump installation.

SUMMARY OF THE INVENTION

The above and other objects of the invention are accomplished by the provision of a centrifugal pump wherein facets which serve as abutments upon attachment are provided on the lower housing part in the region of the respective flange segment and at the pump legs. The facets are located in planes which intersect the shaft axis and are perpendicular thereto. The legs are disposed opposite one another in the direction of the shaft axis and are provided with a force-transmitting and torque-transmitting connection.

In this manner, a motor can very easily be indirectly or directly secured to a housing of this type by means of a flanged connection. If those sides of the housing with the shaft bearings are designated the front sides of the housing, then these are provided with facets in the region of the flange segment. The legs of the pump are likewise provided with facets. The facets serve as abutments upon attachment of additional components. Thus, by means of a flanged connection, a motor casing can be secured to the lower part of the housing with four-point engagement in the region of the flange segment and the pump legs. Since the pump legs which are located opposite one another in the direction of the shaft axis have a force-transmitting and torque-transmitting connection, deformation of the lower housing part with accompanying impairment of shaft journalling is largely eliminated. The forces can be directly conducted into a foundation, frame or the like at the other front side of the housing. By virtue of the exclusive attachment to the lower housing part, the advantage of longitudinally divided pump housings is retained without change. In the event of an inspection or the like, the lower housing part with its connecting flanges can remain directly in the pipe and the motor, which is secured to the lower housing part by a flanged connection, need not be removed. Nevertheless, it is possible to open the housing without problem. The force-transmitting and torque-transmitting connection of the pump legs disposed opposite one another in the direction of the shaft axis can be such that these are formed in pairs as a one-piece cast part. This gives rise to the possibility of direct, linear force transmission. Such possibility does not require a specially equipped housing. Rather, a lower housing part provided with facets of this type can be used for all applications, e.g., for conventional horizontal installation. A pump housing making it possible to achieve versatility in installation is accordingly produced with simple means.

According to another embodiment of the invention, the pump legs and/or the suction and pressure nozzles are provided with facets which serve as an abutment upon attachment. The facets are located in planes which intersect the shaft axis and are perpendicular thereto, and a force-transmitting and torque-transmitting connection exists between pump legs disposed opposite one another in the direction of the shaft axis. In this manner, it is possible to indirectly or directly connect a motor in the region of the suction and pressure nozzles of the lower housing part. By appropriate design of the flanges of the suction and pressure nozzles, mounting can be very easily accomplished.

An embodiment of the invention provides for respective facets to be disposed opposite one another in pairs. This enables manufacture to be simplified and an ideal force and torque flux to be obtained.

A further embodiment of the invention provides for masses of material applied to the lower housing part in the region of the flange segment to constitute part of the facets. For cast housings, in particular, larger facets, and thereby a maximum as regards the loads to be absorbed, can be achieved by simple industrial casting design. Such facets can likewise be readily produced in welded structures. Moreover, it accordingly becomes possible to use standardized elements, e.g., steel shapes among others, for attachment.

Still another embodiment provides for pump legs disposed opposite one another in the direction of the shaft axis to be connected to each other in force-transmitting and torque-transmitting relationship by means of inserts, adjusting elements or the like. In this manner, a rigid connection between two pump legs can be obtained through the simple interposition of intermediate elements. By virtue of an additional embodiment in which the pump legs are provided with openings for tie rods, the components to be secured can be clamped to one another. Instead of the tie rods, it is also possible to provide the facets with fastening means to thereby connect the casing of a motor, for example, directly to the facets.

DESCRIPTION OF PREFERRED EMBODIMENTS

Figure 1:
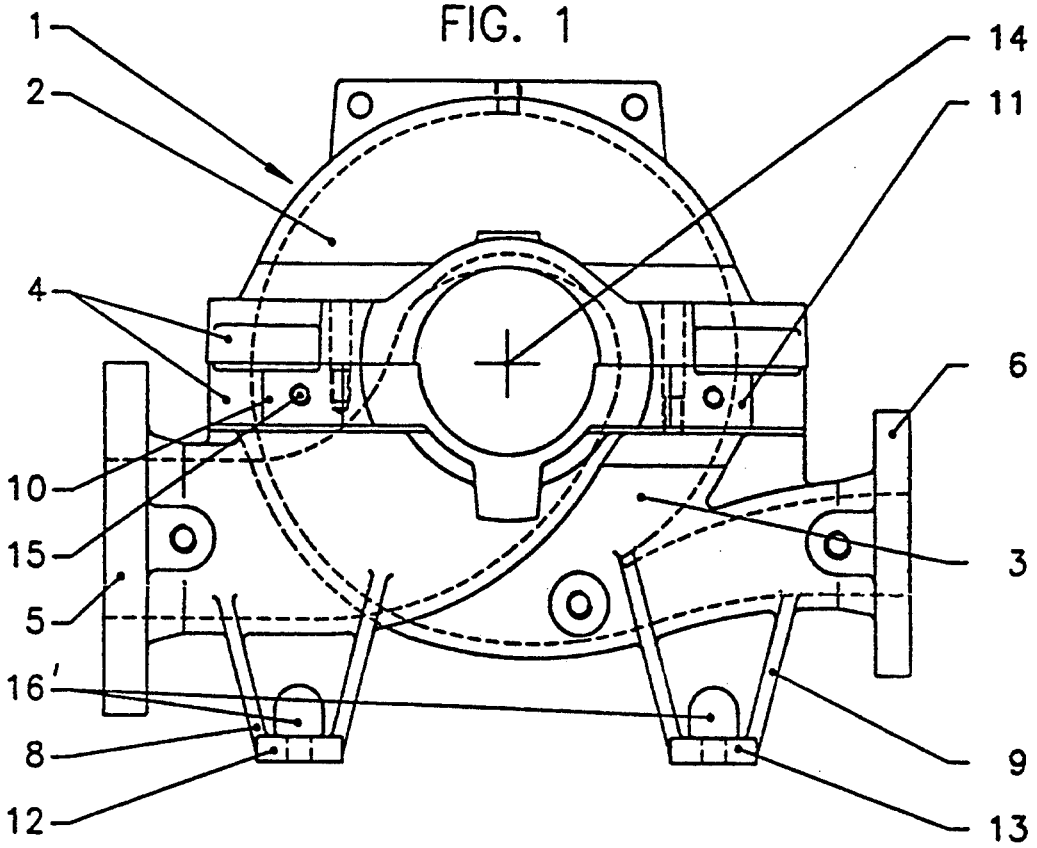
FIG. 1 is an elevational view of the front side of the housing.

The illustration of FIG. 1 shows a centrifugal pump housing 1 which consists of an upper housing part 2 and and a lower housing part 3. Flange segments 4 connect the two halves of the housing. The lower housing part 3 has a suction nozzle 5 and a pressure nozzle 6 as well as pump legs 8,9 which are mounted thereon. The lower housing part further has facets 10,11 in the region of the flange segment and facets 12,13 on the pump legs. These facets are located in a plane which intersects the shaft axis 14 and is perpendicular thereto. The facets 10–13 can be arranged in two or more parallel planes. A motor which is not illustrated here and is to be indirectly or directly secured to the lower housing part comes to rest against these facets. Fastening means 15, here threaded holes, simplify direct attachment to these facets. Openings 16 in the pump legs 8,9 allow clamping by means of through tie rods. These can also be disposed next to the pump legs.

Figure 2:
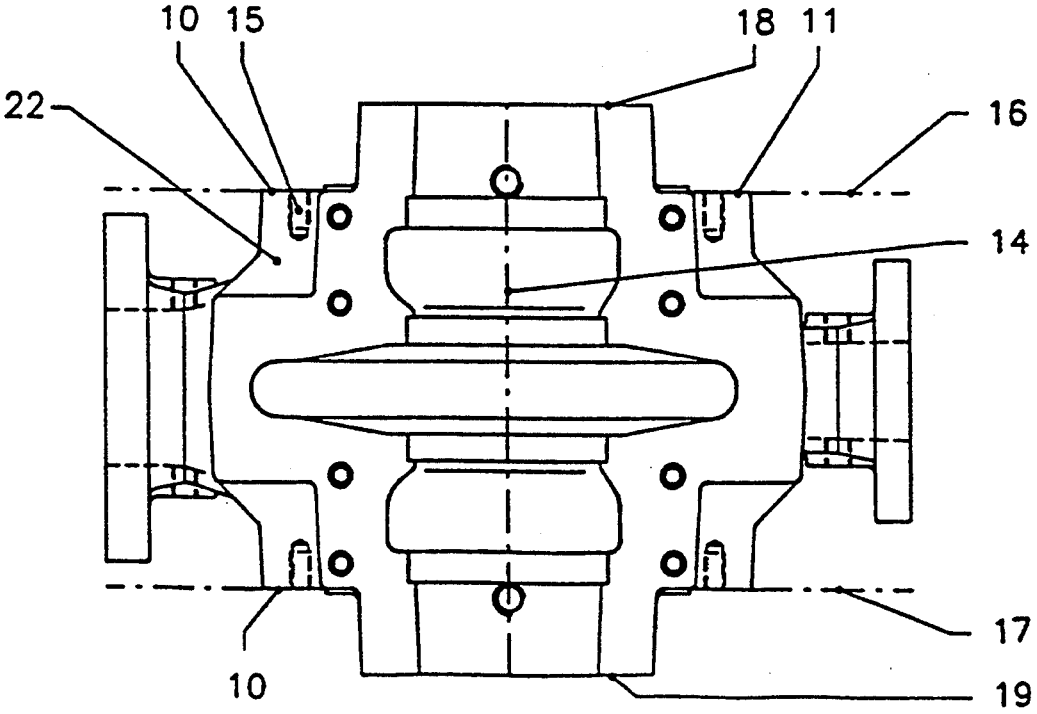
FIG. 2 is a plan view of the lower housing part.

In FIG. 2, which is a plan view of the lower housing part, two planes 16,17 containing the facets 10–13 are shown by dash-and-dot lines. It is readily possible for the facets 12,13 on the pump legs 8,9 to lie in the same planes or in other planes parallel thereto. The bearing cages which carry the pump shaft can be mounted on the flange surfaces 18,19 located in the region of the front sides of the housing. A bearing arrangement within the housing is possible. The facets 10,11 disposed in the region of the flange segment 4 here constitute part of masses 22 of material which, for a cast housing, can be readily cast as part of the same. It is also possible to provide the facets 10–13 on the suction and pressure nozzles 5,6, either additionally or exclusively, to thereby create further possibilities for securing the motor.

Figure 3:
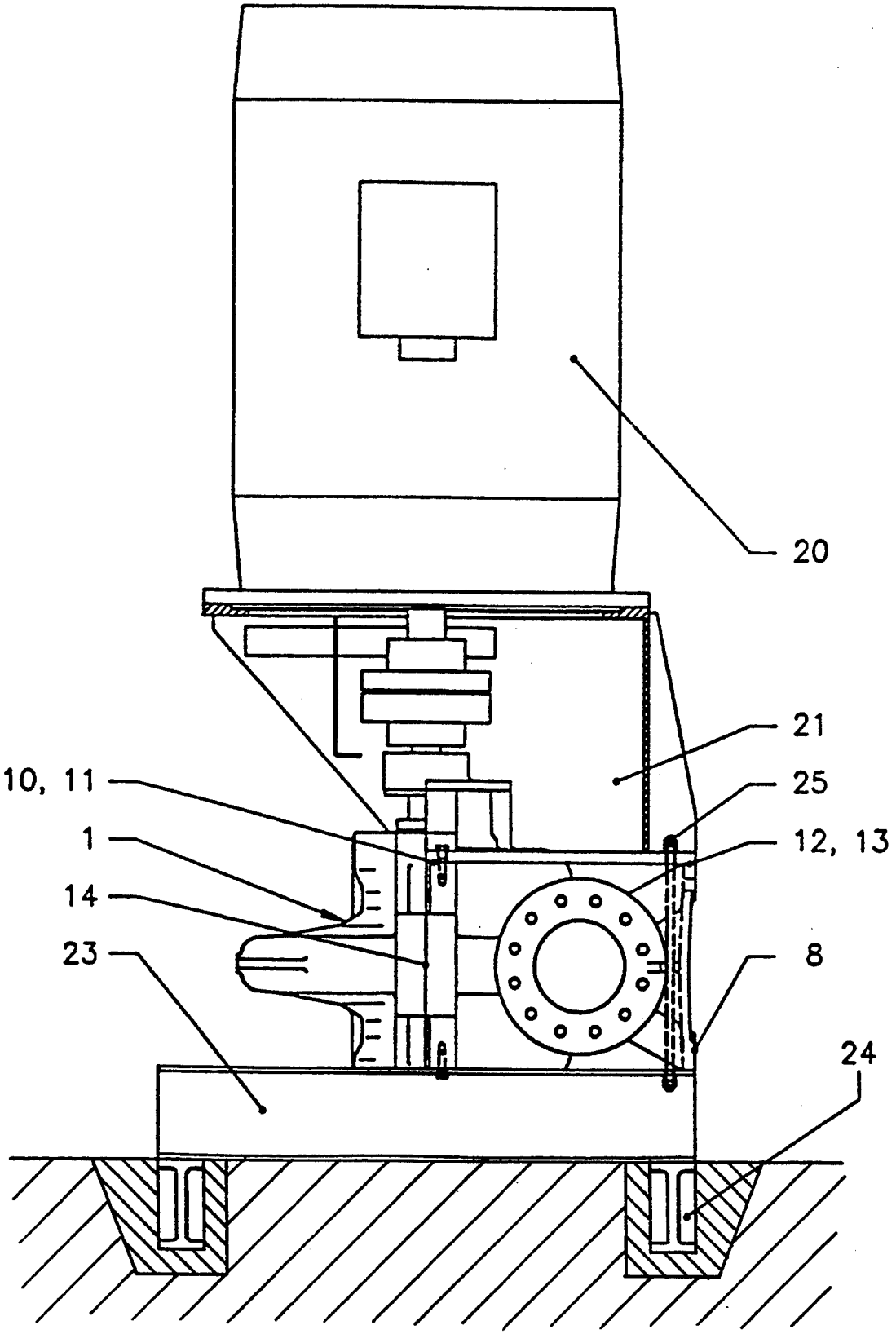
FIG. 3 shows a vertical installation with a block motor secured by a flanged connection.

FIG. 3 shows a vertically installed pump housing 1 provided with a motor 20. The motor 20 is coupled to the facets 10–13 of the lower housing part via a casing 21. The casing 21 is secured to one of the front sides of the housing while the pump rests by way of the other front side of the housing on U-shaped carriers 23 which are connected with a foundation 24. A connection between the casing 21 and the carriers 23 is established in the region of the flange segment by fastening means 15, here screws, which extend into threaded bores of the facets 10,11. In the area of the pump legs 8, which are formed as a one-piece cast section with the lower housing part so that these are joined for force transmission from one to the other, the components are held together via tie rods 25 which clamp the casing 21, the pump legs 8 and the carriers 23 to one another.

We claim:

1. A centrifugal pump comprising a housing; and a shaft rotatable in said housing about a predetermined axis, said housing being divided parallel to said axis and including an upper part and a lower part, said parts including flange segments and said lower part further including suction and pressure nozzles and legs serving for installation, said lower part further including facets which serve as abutments upon attachment of additional components and include facets at the respective flange segment and facets at said legs, said facets being located in planes which intersect and are perpendicular to said axis and said legs being disposed opposite one another in the direction of said axis and being provided with a force-transmitting and torque-transmitting connection.

2. The pump of claim 1, wherein said facets include facets on said legs.

3. The pump of claim 1, wherein said facets include at least one facet on at least one of said nozzles.

4. The pump of claim 1, wherein said facets include pairs of facets and the facets of at least one of said pairs are disposed opposite one another.

5. The pump of claim 1, wherein the facets at the flange section of said lower part include masses of material.

6. The pump of claim 1, wherein said legs are connected to one another by at least one insert.

7. The pump of claim 1, wherein said legs are connected to one another by at least one adjusting element.

8. The pump of claim 1, wherein said legs have openings for tie rods.

9. The pump of claim 1, wherein said facets have fastening means.

* * * * *